United States Patent [19]

Beynon

[11] 4,128,978

[45] Dec. 12, 1978

[54] CONTROLLED EXPANSION SUSPENDED CEILING GRID BEAM

[75] Inventor: John O. Beynon, Waterloo, Canada

[73] Assignee: Ceiling & Drywall Products Limited, Toronto, Canada

[21] Appl. No.: 786,427

[22] Filed: Apr. 11, 1977

[30] Foreign Application Priority Data

Apr. 6, 1977 [CA] Canada ..... 275673

[51] Int. Cl.[2] ..... E04C 3/04; E04B 5/52

[52] U.S. Cl. ..... 52/232; 52/573; 52/729

[58] Field of Search ..... 52/232, 484, 735, DIG. 5, 52/664, 573, 665, 667, 475, 636, 729, 634; 287/189.36 A

[56] References Cited

U.S. PATENT DOCUMENTS

| | | | |
|---|---|---|---|
| 1,763,300 | 6/1930 | Gilbert | 52/634 |
| 2,002,044 | 5/1935 | Rothenstein | 52/636 |
| 3,093,221 | 6/1963 | Purdy | 52/665 X |
| 3,175,655 | 3/1965 | Brown et al. | 52/DIG. 5 |
| 3,239,035 | 3/1966 | Znamirowski | 52/667 X |
| 3,305,256 | 2/1967 | Znamirowski | 52/664 |
| 3,350,125 | 10/1967 | Adams | 52/DIG. 5 |
| 3,388,519 | 6/1968 | Downing, Jr. | 52/573 X |
| 3,397,501 | 8/1968 | Jahn | 52/573 |
| 3,565,474 | 2/1971 | Stumbo et al. | 52/667 X |
| 3,589,089 | 6/1971 | Kedel | 52/232 |
| 3,606,417 | 9/1971 | Rousey | 52/667 X |
| 3,778,947 | 12/1973 | Sauer | 52/232 |
| 4,016,701 | 4/1977 | Beynon | 52/735 |

FOREIGN PATENT DOCUMENTS

| | | | |
|---|---|---|---|
| 848115 | 8/1970 | Canada | 52/DIG. 5 |

*Primary Examiner*—Alfred C. Perham

[57] ABSTRACT

A controlled expansion suspended ceiling grid beam for a suspended panel ceiling comprises a web having a panel supporting flange provided along one of its marginal edges and a bead integral with the other marginal edge. An expansion accommodating portion is provided in the beam for accommodating and localizing thermal expansion. It comprises an arrangement of cut outs in the web which defines three spaced apart notches extending down near to the flange to provide areas of bending for the flange on beam expansion. The bead portion above the cut outs is adapted to collapse on beam expansion. A control means comprising web elements connected to the web portions located between the notches is adapted to resist both separation of and upward movement of the web portions at the beginning of thermal expansion to thereby initiate downward movement of the web portions and hence downward folding of the flange portion away from the bead in accommodating thermal expansion in the beam.

5 Claims, 8 Drawing Figures

CONTROLLED EXPANSION SUSPENDED CEILING GRID BEAM

FIELD OF THE INVENTION

This invention relates to a controlled expansion suspended ceiling grid beam used in suspended panel ceilings having an expansion accommodating portion for localizing and controlling thermal expansion in and thereby minimizing distortion along the beam due to exposure of the beam to the high temperatures of a fire.

BACKGROUND OF THE INVENTION

A structural beam used in suspended panel ceilings is usually fabricated from metal. When such a beam is subjected to heat of a fire the beam expands and if the beam is held fast at its ends, the beam will buckle and distort along its length. When there is no provision in the beam for accommodating such thermal expansion in a controlled manner, such beam distortion can result in the dropping of ceiling tiles or panels from the suspended ceiling. Ceiling panels are usually fabricated from fire retardant material. These ceiling panels should therefore be retained in the suspended ceiling as long as possible during a fire to retard the spread of fire.

SUMMARY OF THE INVENTION

This invention provides an expansion accommodating portion in the beam for accommodating thermal expansion in a controlled manner to provide for minimal distortion along the beam's length so that the ceiling panels are retained in the ceiling to retard the spread of fire until the ceiling suspension system collapses. A beam for a suspended ceiling usually has a web with spaced apart marginal edges, a flange having a panel supporting surface provided along one of the marginal edges and a bead provided along the other marginal edge. The expansion accommodating portion provides an arrangement of cut outs in the web for accommodating beam expansion and adapts a portion of the bead to collapse on beam expansion to localize thermal expansion at a predetermined location in the beam.

The arrangement of cut outs according to this invention provides a control means in the web which ensures a downward folding of the flange portion beneath the cut outs away from the bead so that the cut out configuration can readily accommodate web movement thereinto on beam expansion without disturbance from flange movement. This provides a controlled take-up of thermal expansion in the beam and minimizes distortion along the beam's length.

The arrangement of cut outs in the web serves among other things to define three spaced apart notches extending down at least near to the flange to provide areas of bending for the flange portion between the outermost notches on beam expansion. The arrangement of cut outs is so configured or adapted to allow the web portions attached to the flange portion and located between the three spaced apart notches to move with the flange portion as it bends. A control means is provided for controlling the direction of initial movement of the flange portion at the beginning of thermal expansion in the beam. The control means comprises web elements connected to the web portions on each side of the central notch. Such web elements are adapted to resist both separation of and upward movement of the web portions at the beginning of thermal expansion in the beam. This movement restraint placed on the web portions by the control means thereby initiates the desired downward movement of the web portions because this is the path of least resistance to the folding of the flange portion on taking up beam expansion. According to one aspect of the invention the control means is either unconnected from the bead or the web beneath the bead or disconnects from the bead or the web beneath the bead as the flange portion folds downwardly. This is a desirable embodiment of the invention because the downward folding of the flange portion does not interfer with the collapsing movement in the bead.

The bead portion may be adapted in various ways to provide for its collapse on beam expansion. According to one aspect of the invention, a particular adaptation to the structure of the bead ensures maintenance of its alignment during beam expansion so as to assist in maintaining flange alignment. Such an adaptation is disclosed in my U.S. patent application Ser. No. 634,643, filed Nov. 24, 1975 now U.S. Pat. No. 4,016,701. This adaptation in the bead together with the control arrangement provided by the configuration of cut outs combines to form an expansion accommodating portion in a beam which maintains beam alignment during thermal expansion therein so as to retain the panels in the suspended ceiling over an extended period to retard the spread of fire.

DESCRIPTION OF THE DRAWINGS

These and other advantages and features of the invention will become apparent in the following detailed description of the preferred embodiments of the invention as shown in the drawings wherein.

DETAILED DESCRIPTION OF THE PREFERRED EMBODIMENTS OF THE INVENTION

Figure 1:
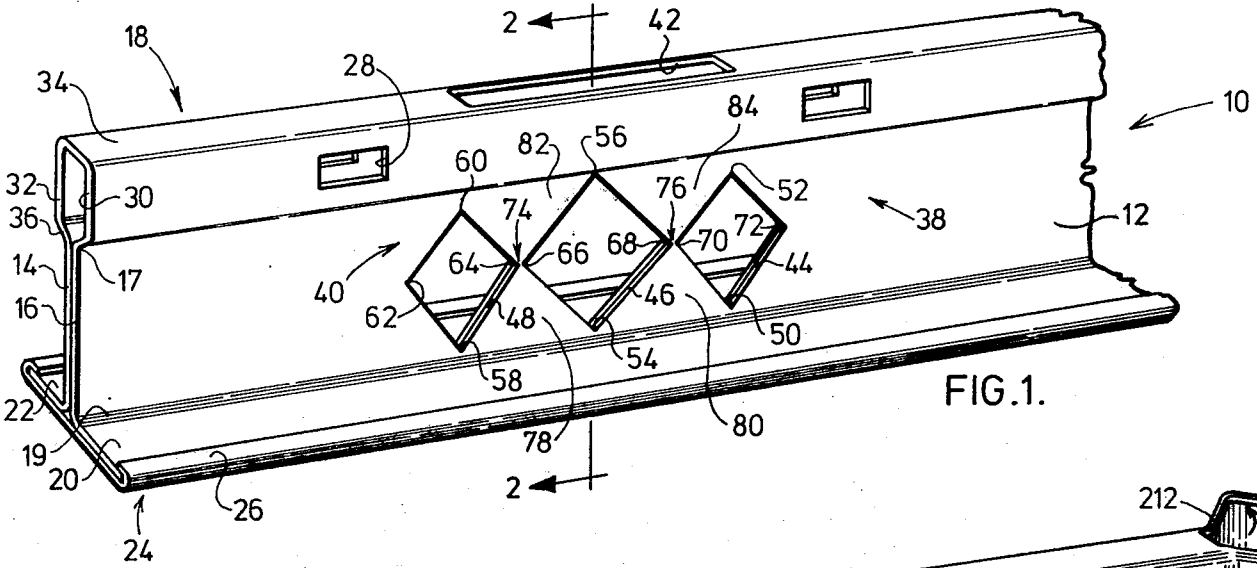
FIG. 1 is a perspective view of a suspended ceiling grid beam having an expansion accommodating portion according to this invention.

FIG. 1 shows a portion of a suspended ceiling grid beam having one type of expansion accommodating portion according to this invention. The beam 10 has a web portion 12 with unconnected double walls 14 and 16 with a bead 18 integrally formed at the upper marginal edge 17 of the web. At the lower marginal edge 19 of the web are outwardly extending leg portions 20 and 22 which form part of the flange structure 24. The leg portions are integrally formed with the web double walls. Enveloping the underside of flange legs 20 and 22 is a wrap 26 which provides a finished appearance on the underside of the beam 10. Ceiling panels to be supported in the suspended ceiling rest on the flange leg portions 20 and 22. The beam 10 is suspended from the superstructure by placing wires through apertures 28 in the bead 18 in the conventional manner.

The bead 18 has side wall portions 30 and 32 with a top wall 34. The base 36 of the bead is integral with the double wall web parts 14 and 16 where the bead side walls 30 and 32 are not connected at the base and are essentially continuous except for the interruptions of apertures 28.

A thermal expansion accommodating portion 38 is provided in the beam to accommodate and control thermal expansion therein when the beam's ends are fixed. The expansion accommodating portion includes an arrangement of cut outs 40 in the double walled web 12 and longitudinally extending slot means 42 in the bead's top wall 34. The expansion accommodating portion 38 takes up movement in the beam during thermal expansion by a longitudinal collapse in the bead portion and a downward folding in the flange. This particular embodiment of the expansion relief cut out configuration 40 consists of three spaced apart quadrilateral shaped cut outs 44, 46, and 48. Each cut out has vertically oriented lower and upper corners 50–52, 54–56, 58 and 60. This arrangement of cut outs by virtue of the lower corners 50, 54 and 58 define three notches which extend down at least near to the plane of flange legs 20 and 22 on which ceiling panels rest.

The three cut outs also have horizontally oriented corners 62–64, 66–68, 70 and 72. The outer cut outs 44, 48 are isolated from the central cut out 46 by narrow cross-sections of web 74, 76 which are located between adjacent horizontal corners 64–66, and 68–70 respectively of the cut outs.

Between notches 50, 54, and 58 are web portions 78 and 80 which are connected to the flange portion between outer notches 50 and 58. To each side of the central cut out 46 there are triangular shaped web elements 82 and 84 which are integral with the base of the bead 18 and which are connected to web portions 78, 80 by narrow web strips 74, 76.

Figure 2:
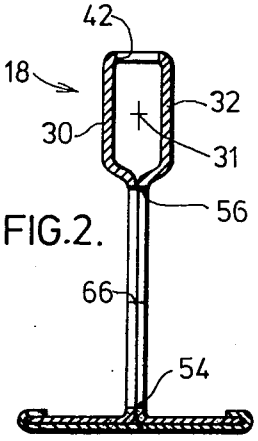
FIG. 2 is a section of the beam along the lines 2—2 of FIG. 1.

The upper corners 52 and 60 of outer cut outs 44, 48 are spaced below the base 36 of bead 18; however, upper corner 56 of cut out 46 extends up to the base 36 of bead 18. The locations in the web of the lower corner 54 and upper corner 56 of the central cut out are more clearly shown in FIG. 2. The width of the slot 42 in the top wall 34 of the bead in the area above the arrangement of cut out 40 is also shown. The bead side walls 30 and 32 are located to each side of the bead's longitudinal axis represented by cross 31.

The specific arrangement of cut outs in FIG. 1 retains some degree of structural strength in the area of the cut out to resist deformation of the flange during beam handling and installation. The arrangement of the cut outs is particularly advantageous in resisting upward bending of the flange beneath the expansion accommodating portion during rough handling. This is desirable because it is necessary to have a downward folding of the flange in taking up thermal expansion; an upward bend in the flange would, of course, detract from this.

Figure 4:
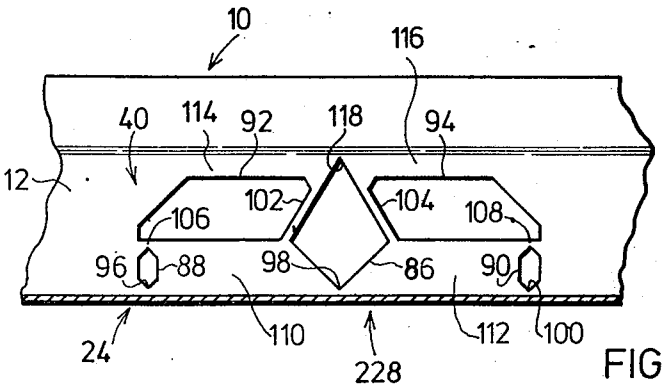
FIG. 4 is a side elevation of a suspended ceiling grid beam showing an alternative cut out configuration in the web portion for the expansion accommodating portion of the beam.

FIG. 4 shows another arrangement of cut outs 40 in the web 12 of the beam 10 for the expansion accommodating portion. The arrangement comprises a central quadrilateral shaped cut out 86, two outer vertically extending slots 88 and 90 and above and on each side of central cut out 86 are elongate cut outs 92 and 94. This arrangement of cut outs defines three spaced apart notches 96, 98, and 100, which extend downwardly near to the flange 24 to provide areas of bending for the flange portion between such notches. The central cut out 86 is isolated from the remaining cut outs in particular 92, 94 by web elements 102, 104 which are in the form of web straps. Cut outs 92, 94 are isolated from the outer cut outs 88, 90 by narrow cross-sections of web 106, 108. Located between the notches 96, 98, 100 are web portions 110 and 112. The cut outs 92, 94 are spaced apart from the base of the bead by web areas 114 and 116. The upper corner 118 of the central cut out 86 extends up to the base of the bead 18. The web straps 102, 104 are connected to the respective web portions 110 and 112 and extend upwardly and are integral with web areas 114, 116 which are in turn supported by and integral with the base of the bead.

Figure 5:
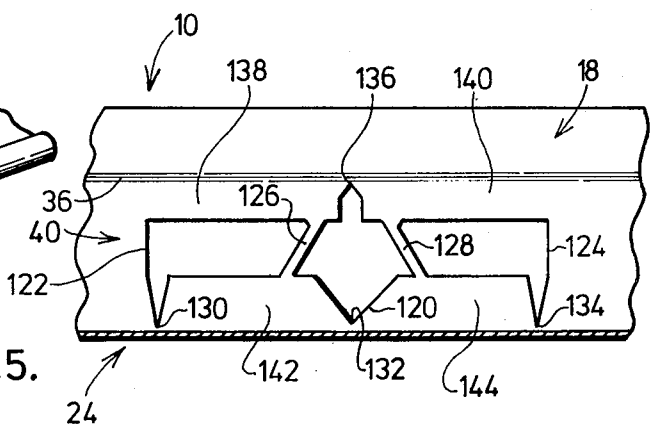
FIG. 5 is a side elevation of a suspended ceiling grid beam showing another alternative cut out configuration in the web portion.

FIG. 5 shows a further alternative arrangement for the cut out configuration 40 in the beam 10. The arrangement of cut outs includes a central cut out 120 and outer cut outs 122 and 124. The outer cut outs are isolated from the central cut out by web straps 126 and 128. The arrangement of cut outs defines three spaced apart notches 130, 132 and 134 which extend down at least near to the flange 24 to provide areas of bending for the flange portion between such notches. The upper end of central cut out 120 has a notch 136 which extends up to the base 36 of bead 18. The upper parts of cut outs 122 and 124 are spaced apart from the bead 18 by web areas 138 and 140. Located between the spaced apart notches 130, 132 134 are web portions 142 and 144. The web straps 126, 128 are connected to the respective web portions 142, 144 adjacent the sides of central notch 132 and extend upwardly and are integral with web areas 138, 140 which are in turn supported by and integral with bead 18.

Figure 6:
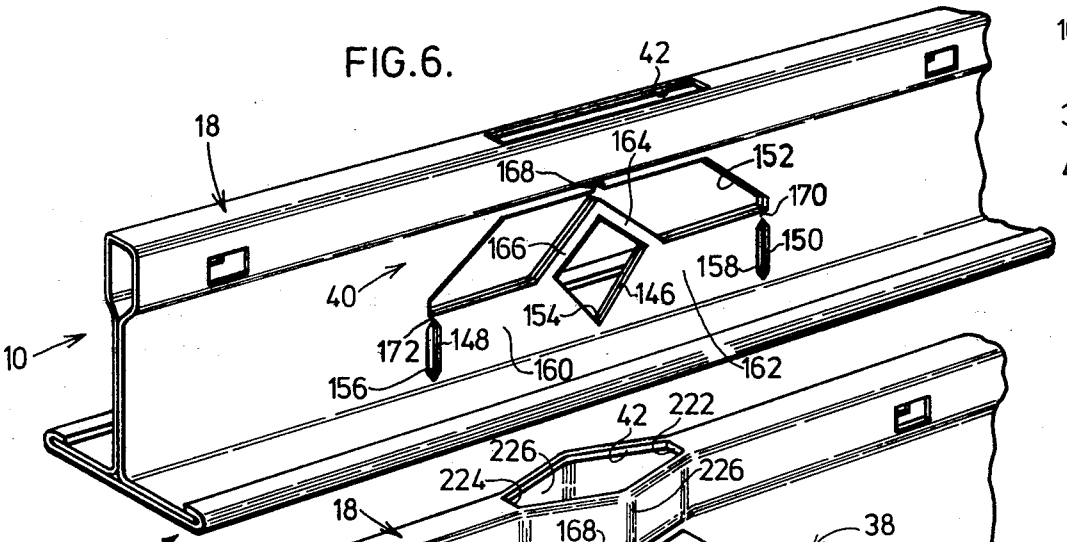
FIG. 6 is a perspective view of a suspended ceiling grid beam showing yet another alternative cut out configuration in the web of the beam.

Turning to FIG. 6, another alternative arrangement for the cut out configuration 40 is shown. It provides a central quadrilateral shaped cut out 146, two outer vertically extending cut outs 148 and 150 and an elongated horizontally extending cut out 152 which bridges the outer cut out 148, 150 and the central cut out 146. Similar to the arrangement of FIG. 1 a slot 42 is cut in the top wall 34 of the bead 18. Cut outs 146, 148, and 150 define three notches 154, 156, and 158, which extend down at least near to the flange 24 to provide areas of bending for the flange portion. Located between these notches and their corresponding cut outs are web portions 160 and 162 which are attached to the flange 24. The central cut out 146 is isolated from the horizontally extending cut out 152 by web straps 164 and 166 which are integral with each other and thereby form an inverted V-shaped web portion. The horizontally extending cut out 152 has notched therein a portion 168 which extends up to the base of the bead 18, the purpose of which will be discussed in more detail hereinafter with respect to FIG. 7. The horizontally extending cut out 152 which bridges the outer cut out is isolated therefrom by narrow web strips or portions 170 and 172 which as will be described in more detail hereinafter break away or sever on beam expansion.

Figure 8:
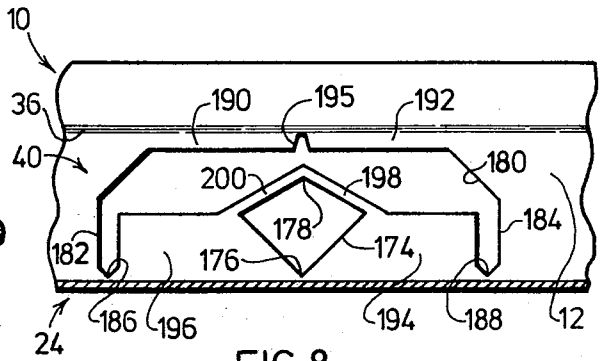
FIG. 8 is a side elevation of a suspended ceiling grid beam showing another alternative cut out configuration in the web portion.

FIG. 8 shows another arrangement of cut outs 40 for the thermal expansion accommodating portion 38 of the beam 10. In this arrangement of cut outs there is a central cut out 174 with vertically oriented corners 176, 178 and a second cut out 180 which extends over central cut out 174 and at its outer extremity extends downwardly at 182 and 184 to define in combination with the central cut out, notches 176, 186 and 188. The notches extend down at least near to the flange 24 to provide locations for bending of the flange portion on taking up thermal expansion. The upper part of cut out 180 is spaced from the base 36 of the bead by web areas 190, 192 and in the central area there is a notch 195 which extends up to the base 36 of the bead 18. Located between the notches are web portions 194 and 196. The central cut out 174 is isolated from the second cut out 180 by web straps 198 and 200 which are integral with one another and thereby form an inverted V-shaped web strap. The web straps 198, 200 are connected respectively to the web portions 194, 196.

Characteristic to each and every one of the above discussed arrangements of cut outs is the provision of a control means which ensures a downward folding of the flange portion about the notches in taking up thermal expansion in the beam because this is the least path of resistance provided by the control means for folding of the flange portion. Also characteristic of the arrangement of cut outs is that it allows the web portion located between the notches and connected to or integral with the flange portion to move downwardly therewith. As with the arrangement of FIG. 1, the embodiments of FIGS. 4, 5, 6 and 8 resist the upward movement of the web portion between the notches. Therefore, during rough handling of the beam on delivery and installation, there is some structural resistance to upward folding of the flange in the area between the outer notches.

Figure 3:
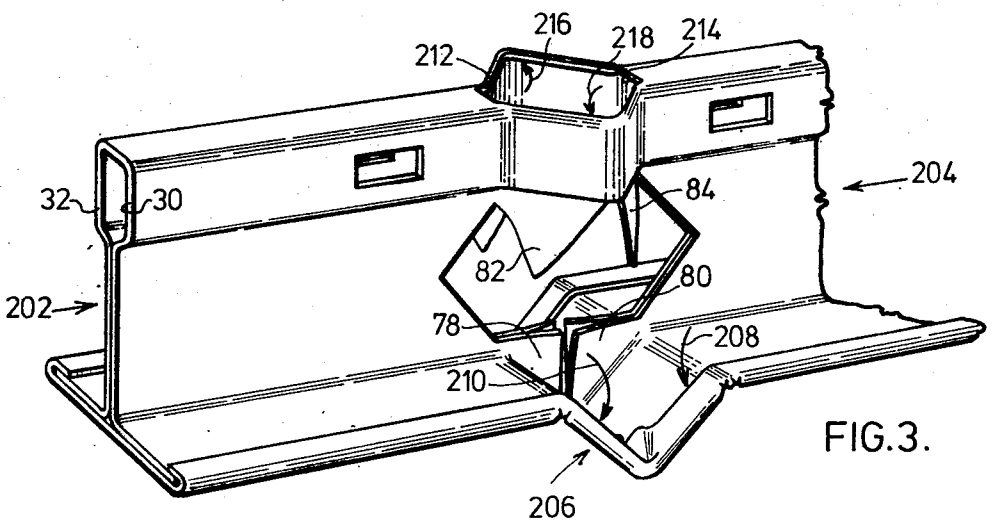
FIG. 3 is a perspective view of the beam of FIG. 1 which has undergone thermal expansion.

A representative shape for the expansion accommodating portion of the beam of FIG. 1 after having been subjected to very high temperatures of a fire is shown in FIG. 3. The reactive forces exerted on the beam with its ends being fixed are represented by arrows 202 and 204. In most situations a fire is started below the level of the suspended ceiling, therefore, the first component of the beam to heat up is the flange 24. The control means according to this invention therefore ensures the downward folding of the flange portion on thermal expansion therein. The control means is constituted by web elements 82, 84 and their connection with web portions 78 and 80. By virtue of the web elements 82, 84 being supported by bead 18, they resist upward movement of and a separation away from each other of web portions 78 and 80. Therefore, in taking up the initial thermal expansion in the beam, the flange portion 206 folds downwardly about the weakened areas provided by notches 50, 54 and 58 because this is the path of least resistance to the folding action of the flange as determined by the web elements 82, 84 of the control means. After the downward folding of the flange portion 206 has been initiated in the direction of arrows 208 and 210, the narrow web strips 74, 76 extend and sever to free the web portions 78 and 80 from the remaining part of the web to allow them to move downwardly with the continued folding of flange portion 206. As a result the flange and the portions connected thereto move away from the bead thereby allowing the arrangement of cut outs to accommodate movement thereinto of web material on each side of the outer cut outs in taking up thermal expansion.

In conjunction with the downward folding of the flange, the bead side walls 30, 32 above the cut outs buckle outwardly in the direction of arrows 216 and 218 by virtue of their being located on opposite sides of the bead's axis 31 and being unconnected at their top as provided by slot 42 and unconnected at their bottom. This balanced collapse in the bead sidewalls provides a control on the bead portions 212 and 214 approaching one another in a telescopic like manner so as to maintain bead alignment. The areas of bending in the bead sidewalls are located by virtue of the upper corners 52, 56 and 60 of the cut outs. The web elements 82, 84 are in pairs because of the double walled web and therefore move with the respective bead sidewall. The web elements in being integral with the bead's base reinforce it so that the buckling of the sidewalls tend to be triangular in nature as representatively shown in FIG. 3. The web portions 78 and 80 as they move away from the bead do not interfere with the collapsing movement or buckling movement in the bead side walls 30 and 32. Because of the maintenance of bead alignment, this tends to maintain the desirable alignment in the flange apart from the downwardly folding flange portion. The extent to which the flange portion 206 folds downwardly depends upon the extent of thermal expansion in the beam and the number of expansion accommodating portions in any one length of beam. However, in extreme situations the flange portion may fold downwardly to the extent that the web portions 78 and 80 may meet one another and mesh.

Figure 7:
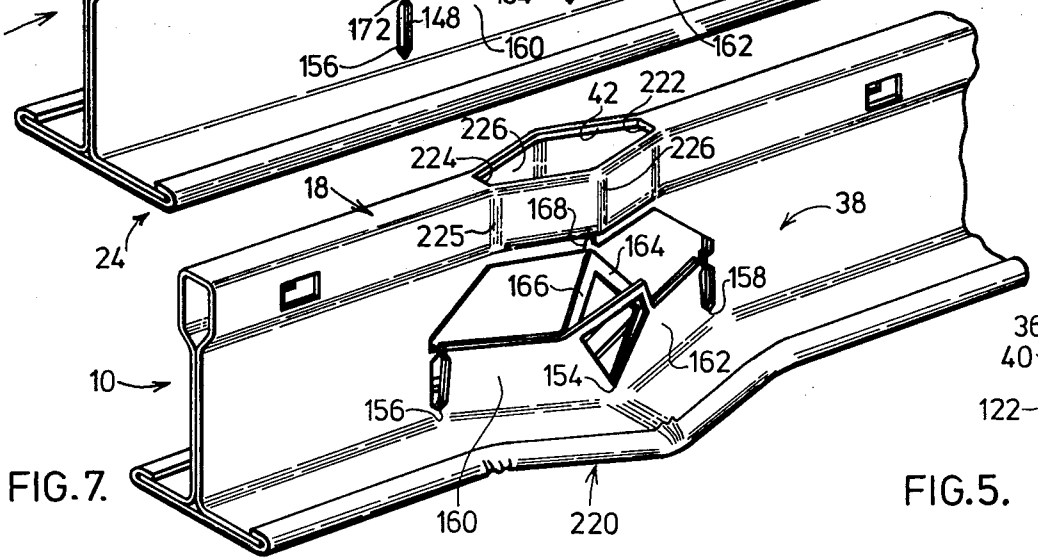
FIG. 7 is a perspective view of the beam of FIG. 6 which has undergone thermal expansion.

A representative illustration in FIG. 7 shows the beam 10 of FIG. 6 after having been subjected to the heat of a fire. The expansion accommodating portion 38 has taken up the thermal expansion in the beam in the manner shown. The bead 18 of the beam has been adapted in a manner similar to that of FIG. 1 to collapse on beam expansion. The flange portion 220 between the notches 150, 154 and 156 is initiated to fold downwardly by virtue of the control means provided by web straps 164, 166. The notches 150, 154 and 156 provide areas of bending for the flange portion 220 on taking up thermal expansion. The web straps 164, 166 tie the web portions 160 and 162 together because the straps are interconnected. They therefore resist separation or movement away from each other of web portions 160 and 162. In turn this resists an upward movement of such web portions. As a result in taking up thermal expansion, the flange portion 220 is induced to move downwardly because this is the path of least resistance to the movement of the web portions 160, 162 as determined by the web straps 164, 166 of the control means. Therefore the desired downward folding of the flange portion 220 has been initiated so that the cut out arrangements can accommodate movement thereinto of web located to each side of the cut outs.

During the take-up of thermal expansion in the beam web strips 170 and 172 extend and sever to free the web portions 160 and 162 in the manner shown in FIG. 7 to allow them to move downwardly with the folding of flange portion 220. In this downward movement of the flange portion, the web straps 164 and 166 fold onto each other and may deflect laterally outwardly from each other as shown in FIG. 7.

The bead 18 is adapted by slot 42 to collapse in the same manner as discussed with respect to FIG. 3. The top wall portions 222 and 224 approach one another in a telescopic like manner as the sidewalls buckle outwardly about areas 226 and 225. The upper notch 168 of cut out 152 locates the central area of bending at 226. This maintenance of bead alignment and hence flange alignment provides a desirable model for an expansion accommodating portion to retain ceiling panels in the ceiling for as long as possible to retard the spread of fire.

As can be appreciated from the discussion of thermal expansion take-up in the beams of FIG. 3 and 7, the operation of the expansion accommodating portions in FIGS. 4, 5 and 8 is somewhat the same. The bead of the beams in the remaining Figures may be adapted in a manner similar to that of FIGS. 1 and 6 to collapse or buckle on beam expansion.

Turning to FIG. 4, the web straps 102, 104 resist upward movement and hence separation of web portions 110, 112. Therefore on beam expansion, the flange portion 228 between the notches 96, 98 and 100 will fold downwardly in the direction of least resistance to its movement. The web straps 102, 104 as supported by the bead 18 act as struts to resist the upward movement of and separation apart from one another of web portions 110, 112. During the take-up of thermal expansion, the narrow cross-sections of web 106, 108 extend and sever. Depending upon the geometry of the cut out arrangement, the web straps 102, 104 after having initiated the downward folding of flange portion 228, may extend providing the downward folding of the flange portion is sufficient. If the downward folding of the flange portion is to a greater extent, the web straps may part or break. At this point in accommodating thermal expansion, the breaking of web straps is unimportant because the downward folding of the flange is well on its way.

A similar type of operation in accommodating beam expansion is provided in the beam of FIG. 5 where the web straps 126, 128 resist upward movement of web portions 142, 144; therefore, the downward folding of the flange portion between the notches 130, 132, 134 is initiated. The web straps 126, 128 move with the web portions 142, 144 and depending upon the degree of downward folding of the flange, the web straps 126, 128 may sever.

With the embodiment shown in FIG. 8, the web straps 198, 200 by virtue of their being integral with one another, resist separation of movement away from each other of web portions 194, 196. As was discussed with respect to the embodiment shown in FIG. 7, the web portions 194, 196 therefore move downwardly on take-up of beam expansion as the flange portion between notches 186, 188 folds downwardly. The web straps 198, 200 may fold toward each other in a manner similar to that discussed with respect to the arrangement of cut outs in FIG. 7.

It is therefore apparent from this discussion of the various preferred embodiments of the arrangement of the cut outs that a control means is provided to ensure downward folding of the flange portions on initial beam expansion so as to permit the web on opposite sides of the cut out arrangement to move thereinto on beam expansion. The bead may be adapted in various manners to buckle longitudinally in taking up thermal expansion and it is understood that other arrangements may be used to weaken or alter the structure of the bead to permit its collapse. For example, the bead sidewalls may be pinched inwardly in certain areas to initiate the buckling thereof particularly with bead configurations differing from that shown. However, as discussed, the slot means provided in the bead top wall gives the desired feature of maintaining beam alignment on the take-up of thermal expansion. It is also appreciated that the arrangement of cut outs according to this invention is equally applicable to use in beams having a single walled web.

Although various preferred embodiments of the invention have been described herein in detail, it will be understood by those skilled in the art that operative variations may be made thereto without departing from the spirit of the invention or the scope of the dependent claim.

What is claimed is:

1. A controlled expansion suspended ceiling grid beam for a suspended panel ceiling, said beam having a web with spaced apart marginal edges, a flange having a panel supporting surface provided along one of said marginal edges, a bead provided along the other marginal edge, and an expansion accommodating portion for accommodating thermal expansion at a pre-determined location in said beam, said bead having substantially flat spaced apart sidewalls which lie on apposite sides of the bead axis and which are continuous at least along the upper and lower bead portions and an interconnecting substantially flat top wall, said sidewalls being essentially unconnected at the bead's base, said expansion accommodating portion comprising an arrangement of cut outs for accommodating thermal expansion in the web and longitudinal slot means cut in the beads topwall for essentially disconnecting at the top the bead sidewalls along the length of the said slot means, said cut outs defining three spaced apart notches extending down at least near to said flange to provide areas of bending for a flange portion on beam expansion, said arrangement of cut outs being so configured as to allow the two web portions attached to said flange portion and located between said three spaced apart notches to move with said flange portion as it bends, a control means for controlling initial movement of said flange portion at the beginning of thermal expansion in said beam, said control means comprising web elements connected to said web portions on each side of the central notch, said web elements being adapted to resist both separation of and upward movement of said web portions at the beginning of thermal expansion in said beam, the arrangement being such that thermal expansion in said beam is accommodated by a downward folding of said flange portion initiated by virtue of the movement restraint placed on said web portions by said web elements and said spaced apart bead sidewalls by virtue of their being essentially unconnected at the top and bottom and lying on opposite sides of the bead's axis buckling laterally outwardly away from each other without interference from the movement of said web portions, said expansion accommodating portion controlling the direction of folding in said flange portion and controlling movement of the beam portions at opposite ends of the slot means to cause said bead portions to move towards each other while maintaining bead and beam alignment and hence flange alignment apart from the downwardly folding flange portion.

2. A controlled expansion suspended ceiling grid beam of claim 1 wherein said arrangement of cut outs provides three quadrilateral shaped cut outs, each of which has a pair of vertically oriented opposing corners, the lower of said corners defining the lowermost extent of the respective notch, the adjacent corners of each cut out being separated by a narrow cross-section of web which joins the triangular shaped web element located beneath said bead and on a side of the central cut out to the respective web portion, said triangular shaped web elements as supported by said bead resist both separation and upward movement of said web portions thereby initiating the desired downward folding of said flange portion, said narrow cross-sections of web extending and severing after initial thermal expansion in said beam to free said two web portions and allow them to continue moving downwardly with the downward folding of said flange portion.

3. A controlled expansion suspended ceiling grid beam of claim 1 wherein a central cut out associated with the central notch is isolated from remaining web cut outs by said web elements in the form of web straps, each strap extending upwardly from the respective one of said web portions and is integral with the base of said bead, each web strap by virtue of support provided by said bead resists upward movement of the respective web portion on initial thermal expansion in said beam to thereby initiate the desired downward folding of said flange portion.

4. A controlled expansion suspended ceiling grid beam of claim 3 wherein said arrangement of cut outs provides a central quadrilateral shaped cut out with opposing vertically oriented corners to define a central notch, an outer cut out to each side of central cut out and a horizontally extending cut out bridging said central cut out and said outer cut outs, said horizontally extending cut out being isolated from the outer cut outs by narrow cross-sections of web which extend and sever during thermal expansion in said beam to free said web portions to allow them to move with the downward folding of said flange portion said web straps being integral with one another and forming an inverted V-shaped web strap which ties said web portions together and isolates said central cut out from said horizontally extending cut out, said inverted V-shaped web strap resisting both separation of and upward movement of said web portions on initial thermal expansion in said beam to thereby initiate the desired downward folding of said flange portion.

5. A controlled expansion suspended ceiling grid beam of claim 4 wherein said web is double walled with said bead side walls being integral therewith, said cut outs extending through the double walled web, said inverted V-shaped web portion consisting of two pairs of legs which fold towards each other after initiation of the downward folding of the flange portion, the pairs of legs during their folding movement resisting lateral displacement of said web portions which would tend to offset longitudinal alignment of said flange during thermal expansion in said beam, such resistance to lateral displacement of said web portions in combination with the control on the buckling of the bead side walls maintaining bead and beam alignment and hence flange alignment apart from the downwardly folding flange portion.

* * * * *